United States Patent [19]

Burroughs

[11] Patent Number: 5,076,188

[45] Date of Patent: Dec. 31, 1991

[54] HATCH COVER

[75] Inventor: Kenneth N. Burroughs, Long View, Tex.

[73] Assignee: Skeeter Products, Inc., Kilgore, Tex.

[21] Appl. No.: 529,155

[22] Filed: May 25, 1990

[51] Int. Cl.[5] ..... B63B 19/12

[52] U.S. Cl. ..... 114/201 R; 49/501; 114/173

[58] Field of Search ..... 114/116, 117, 173, 177, 114/176, 178, 201 R–203, 335, 74 A; 49/381, 383, 400, 475, 483, 486, 501; 220/344, 378

[56] References Cited

U.S. PATENT DOCUMENTS

| | | | |
|---|---|---|---|
| 2,400,614 | 5/1946 | Vivian | 220/344 X |
| 2,828,176 | 3/1958 | Burgh | 220/344 X |
| 3,291,514 | 12/1966 | Isaksson | 292/256.5 |
| 3,352,447 | 11/1967 | Hahn | 220/378 |
| 3,796,179 | 3/1974 | Kummerman | 114/201 R |
| 3,821,935 | 7/1974 | Adler | 105/377 |
| 4,239,008 | 12/1980 | Conlon | 105/377 |
| 4,385,580 | 5/1983 | Davidson | 114/201 R |
| 4,811,680 | 3/1989 | Genth | 114/201 R |

FOREIGN PATENT DOCUMENTS

| | | | |
|---|---|---|---|
| 550718 | 11/1956 | Italy | 114/201 R |
| 0118595 | 7/1984 | Japan | 114/201 R |
| 281874 | 12/1927 | United Kingdom | 114/201 R |

*Primary Examiner*—Ed Swinehart

*Attorney, Agent, or Firm*—Tilton, Fallon, Lungmus & Chestnut

[57] ABSTRACT

A cover for a hatch includes a rigid main body member and a sealing member secured to the main body member. The sealing member is an expanded polyethylene foam; and it extends across the hatch and engages the portion of the structural member or deck adjacent the hatch. The sealing member, thus, seals the hatch and insulates the compartment below the hatch. It acts as a gasket seal for the cover, and provides sound dampening, corrosion protection, and other advantages.

9 Claims, 1 Drawing Sheet

HATCH COVER

BACKGROUND OF THE INVENTION

1. Field Of The Invention

The present invention relates to a cover for an opening, and more particularly, a hatch cover for closing a hatch in the deck of a boat or ship.

2. Description Of The Prior Art

In many applications, hatch covers should provide the following features:

(a) a rugged construction to withstand the weight of heavy items and individuals;
(b) thermal insulation which reduces moisture condensation on one side of the cover;
(c) a gasket-type seal to reduce the flow of water and air through the opening which the hatch cover closes;
(d) galvonic isolation from mounting hardware;
(e) electric isolation to reduce the risk of arcing from electrical short circuits; and
(f) sound dampening to minimize sound transfer through the opening which the hatch cover closes and to reduce the noise generated by items dropped on the cover or by the closing of the cover.

One application which requires these features is a hatch cover for the deck of a water craft.

The prior art includes a wide variety of covers for closing hatches. However, due to various inherent design characteristics, these prior covers do not provide the features outlined above. They do not provide an effective closure, especially for applications such as the water craft application identified above.

The hatch cover of the present invention provides the above features. It has a simple construction which greatly minimizes the expense of manufacture and assembly while providing the outlined advantages. It comprises a small number of components which provide an effective closure and an attractive addition to the structural member whose opening it closes.

SUMMARY OF THE INVENTION

In accordance with one embodiment of the present invention, a hatch cover includes a rigid, main body member made of metal or any other material of high strength and rigidity. This main body member includes a top portion and a rim portion which lies at an angle to the top portion and extends around its periphery.

The cover also includes a resilient sealing member fixedly secured to the main body member with permanent adhesive or any other suitable securing means. The sealing member engages the portion of the partition or deck surrounding the opening which the cover closes. It extends across the opening and completely closes it.

A protective layer, e.g., all-weather carpeting, fixedly secured to the main body member with permanent adhesive or other suitable means, covers that portion of the main body member surface which the resilient sealing member does not cover. It protects the main body member and provides an attractive finish for the cover. The cover also includes a handle so that a user may easily move it.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations or fragmentary views may, in part, illustrate the embodiment. In certain instances, the disclosure may not include details which are not necessary for an understanding of the present invention.

DETAILED DESCRIPTION OF THE DRAWINGS AND AN EMBODIMENT

Figure 1:
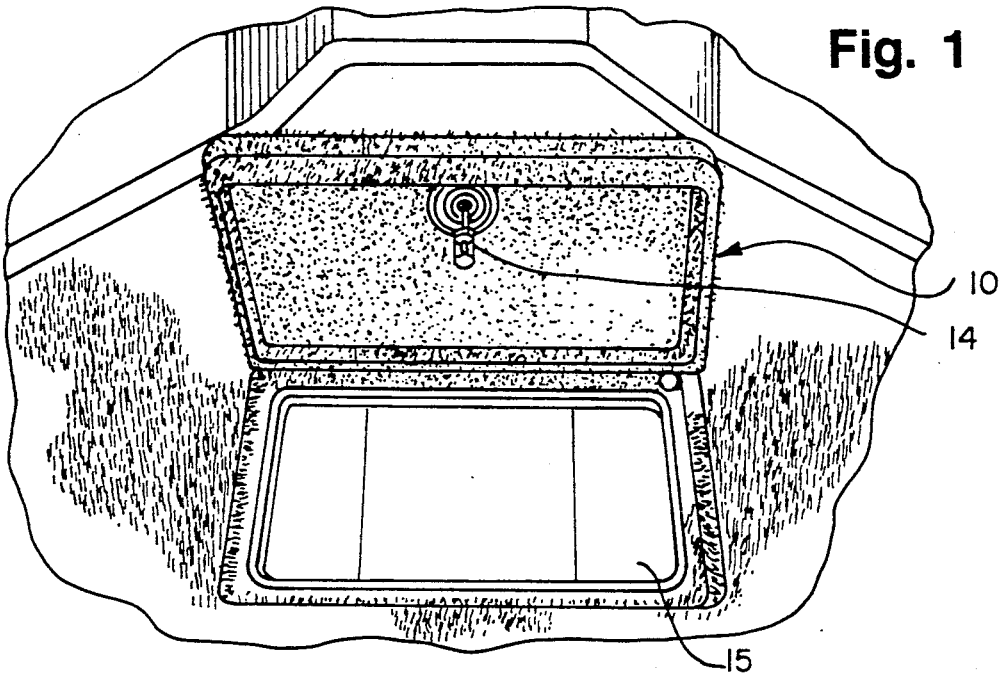
FIG. 1 is a perspective view of the hatch cover of the present invention, showing the cover in an open position over a hatch in a deck of a water craft.
Figure 2:
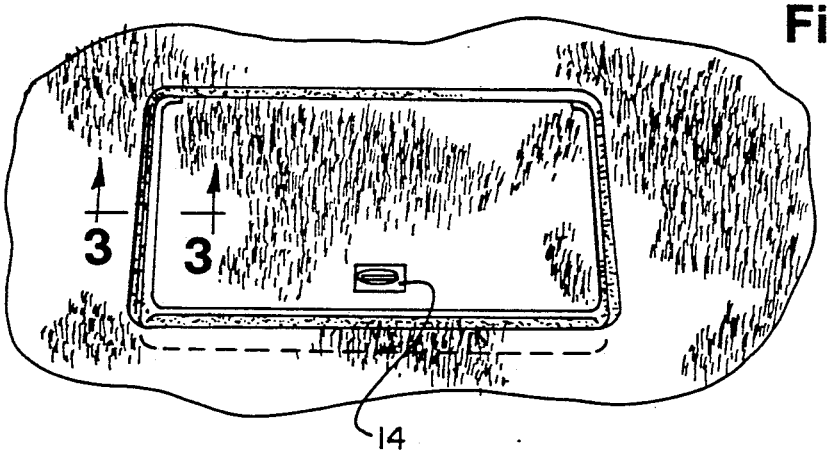
FIG. 2 is a perspective view of the hatch cover, showing the hatch cover in a closed position.
Figure 3:
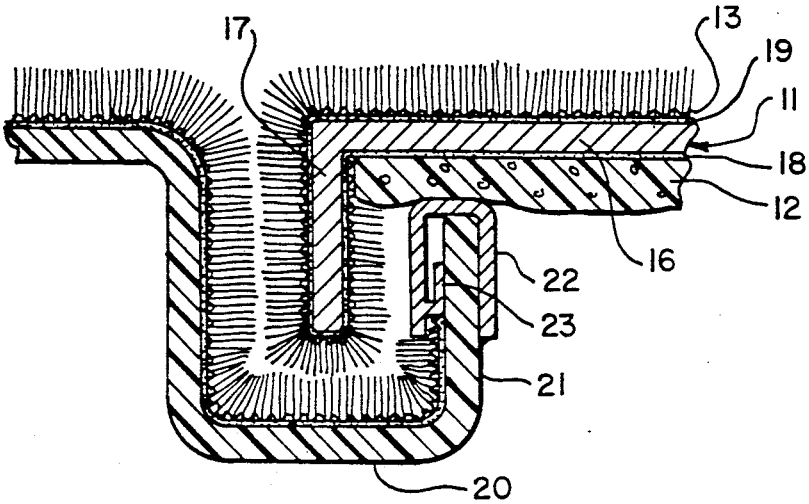
FIG. 3 is a sectional view taken along the line 3—3 in FIG. 2.

Turning now to the drawings, FIGS. 1–3 illustrate one embodiment of the hatch cover of the present invention at 10. The cover 10 generally includes a main body member 11, a sealing member 12, a protective layer 13, and a handle 14 (See FIGS. 1 and 2). It closes a hatch 15 defined by the deck of a water craft or any other partition of a structure.

The main body member 11 is a cap-like component made out of a metal such as aluminum or any other material of sufficient strength, rigidity and weight. This member 11 includes a top portion 16 which has a rectangular shape similar to the shape of the hatch 15. The portion 16 has a width and length slightly greater than that of the hatch so that its end portions extend beyond the hatch. The member 11 also includes a rim portion 17 which extends around the periphery of the top portion and lies perpendicularly to the top portion 16.

The sealing member 12 is a sheet of resilient material. It has a rectangular shape and a predetermined thickness; and it serves as a moisture barrier, electric insulator, and noise dampener. It is any material which provides these characteristics, e.g., expanded, closed cell polyethylene foam. It has a thickness greater than the thickness of the top portion 16 of the main body member 11 (e.g., 0.090 to 0.125 inches for the top portion compared to 0.25 inches for the sealing member). A permanent adhesive 18 or any other suitable securing means fixedly secures the sealing member 12 to the top portion 16 of the main body member 11 in substantial co-extensive relation with the top portion 16 within the rim portion 17.

The protective layer 13 lies over that portion of the surface area of the main body member 11 which the sealing member 12 does not cover. A permanent adhesive 19 or any other suitable securing means secures this protective layer 13 to the main body member 11. The layer 13 is all-weather carpeting or any other material which has characteristics similar to those of the sealing member 12.

The handle 14 (See FIGS. 1 and 2) is a pull-out type handle which allows manipulation of the cover, especially removal of the cover 10 from the hatch. When the cover lies in the closed position as shown in FIG. 2, the handle lies flush with the surface of a cover so that an individual walking on the deck will not trip over it.

The cover 10 shown in FIGS. 1-3 is a cap-like member which stays in place over the hatch under its own weight. Alternatively, hinge members may hingedly connect the cover to the deck. As shown, the rim of the cover extends into a channel 20 which comprises the portion of the deck disposed around the hatch 15. This channel includes a flange 21 which supports a footing strip 22.

The strip 22 engages the sealing member 12 and acts as a footing for the cover 10. In cross-section, it has the shape of an inverted U; and it receives the top of the flange 21 in the space between the two legs of the U. This space has a width greater than the thickness of the flange 21 so that carpeting secured to the deck may also extend between the legs · i the strip 22 (See FIG. 3). The strip includes a finger 23 which engages the side of the flange 21 and facilitates a press fit over the flange 21.

The rim of the cover 10 lies in overlapping or telescoping relation with the flange 21 as shown in FIG. 3. Any moisture which collects in the channel 20 will not move through the hatch 15 due to the seal provided by the sealing member 12. However, the channel 20 may include a drain (not shown) for removing the moisture.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. The applicant intends to cover any such modification and other embodiments which incorporate those features which constitute the essential features of this invention.

What is claimed is:

1. A cover for a hatch defined by a structural member with a portion which lies adjacent the hatch, said cover comprising: a rigid main body member; and a sealing member secured to the main body member for engaging the structural member portion adjacent the hatch, said sealing member having a predetermined area to close the hatch; a protective layer secured to the main body member, the protective layer and the sealing member covering substantially all of the surface of the main body member, said sealing member and protective layer being secured to the main body member with permanent adhesive.

2. The cover of claim 1, wherein the main body member includes a top portion and a rim portion which extends at an angle to the top portion and lies around the periphery of the top portion.

3. The cover of claim 2, wherein the top portion is a flat plate with a rectangular configuration and the rim portion extends perpendicularly to it.

4. The cover of claim 3, wherein the main body member is a one-piece, integrally molded unit made of metal.

5. The cover of claim 2, wherein the sealing member is substantially co-extensive with the top segment.

6. The cover of claim 5, wherein the sealing member is made of expanded polyethylene foam.

7. The cover of claim 1, wherein the protective layer is an all-weather carpet.

8. The cover of claim 1, further comprising handle means for moving said cover.

9. A cover for a hatch defined by a deck member which includes a collar disposed around the hatch, said cover comprising: a rigid main body member including a top portion and a rim portion which lies in overlapping relation with the collar of the structural member when the cover lies in place over the hatch; a resilient sealing member secured to the main body member for engaging the collar of the deck member, said sealing member being substantially co-extensive with the top portion of the main body member and closing the hatch when the cover lies in place over the hatch; a protective layer secured to the main body member, said protective layer and the sealing member covering substantially all of the surface area of the main body member; and handle means secured to the main body member for moving the cover.

* * * * *